United States Patent [19]

Guthrie

[11] 4,350,172

[45] Sep. 21, 1982

[54] TOBACCO STRIPPER

[76] Inventor: James Guthrie, Guthrie Farm Service, King St., Eminence, Ky. 40019

[21] Appl. No.: 200,564

[22] Filed: Oct. 24, 1980

[51] Int. Cl.[3] ..... A24B 3/00; A24B 3/07

[52] U.S. Cl. ..... 131/322; 130/30 R

[58] Field of Search ..... 131/332; 130/30 R

[56] References Cited

U.S. PATENT DOCUMENTS

| | | | |
|---|---|---|---|
| 527,885 | 10/1894 | Reid | 131/322 |
| 2,574,030 | 11/1951 | Green | 131/322 |
| 2,989,056 | 6/1961 | La Motte | 131/322 |
| 3,380,460 | 4/1968 | Fuis, Jr. et al. | 131/322 |
| 3,765,424 | 10/1973 | Morrison et al. | 131/322 |

*Primary Examiner*—V. Millin

[57] ABSTRACT

This machine is for stripping the leaves from tobacco stalks, so as to confine the "tip grade" leaves in one container, the "leaf grade" in another container, and the "trash grade" in another container, in order to get the tobacco to the market in the three different grades. It consists primarily of a base member, in which are three openings for each of the three grades of tobacco to fall into the containers, and the upper portion includes a multiple number of extending tubes, with cutters upon them, that are motor driven by belts and pulleys, for stripping the tobacco from the stalks.

2 Claims, 4 Drawing Figures

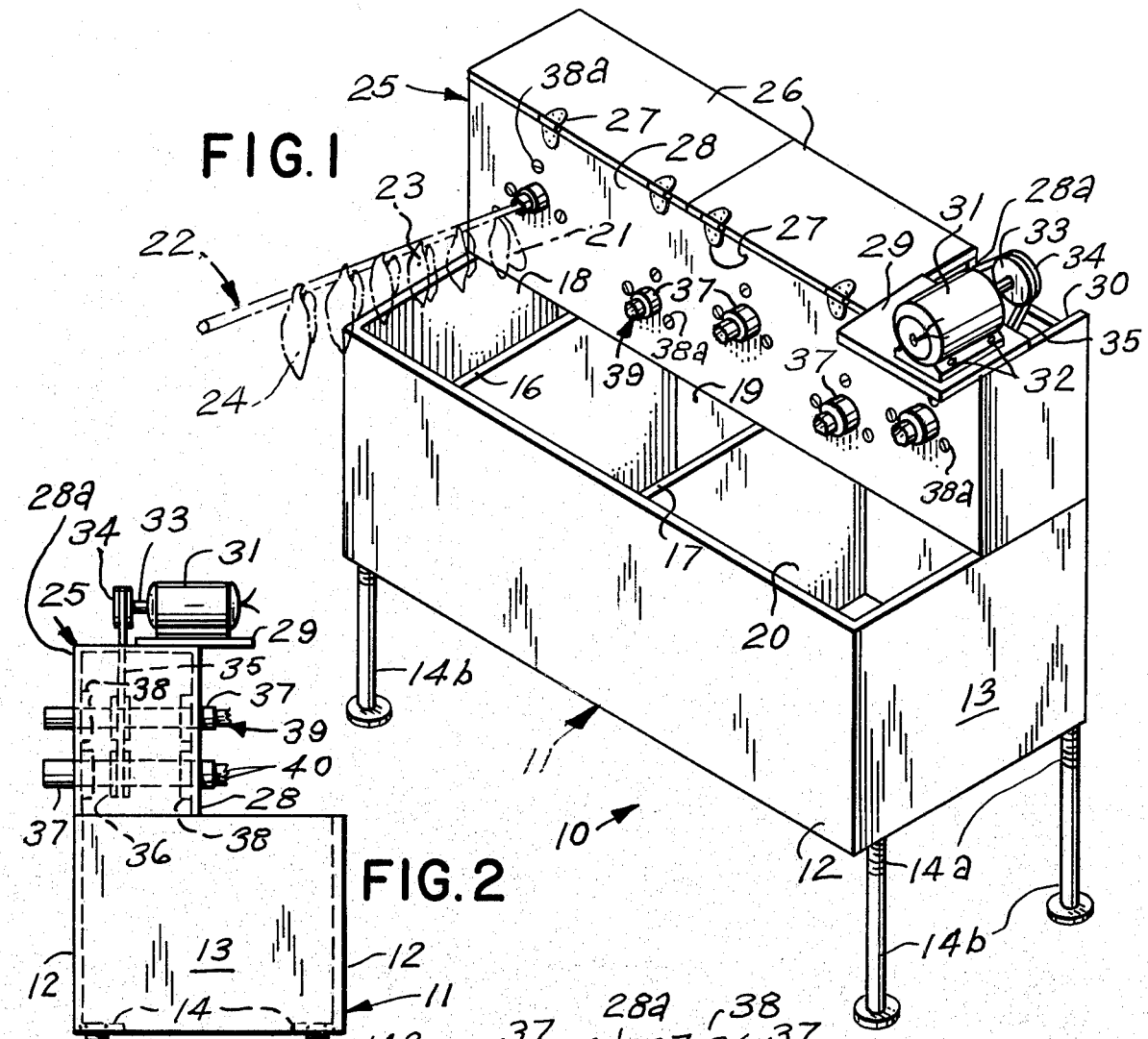
FIG. 1
25
26
38a
27
28
23
22
21
18
37
39
38a
16
19
24
29
31
28a
33
34
30
35
32
17
20
13
14b
11
10
12
14a
FIG. 2
28a
34
33
31
25
29
35
38
37
39
40
28
36
13
12
11
14
14a
14b
10
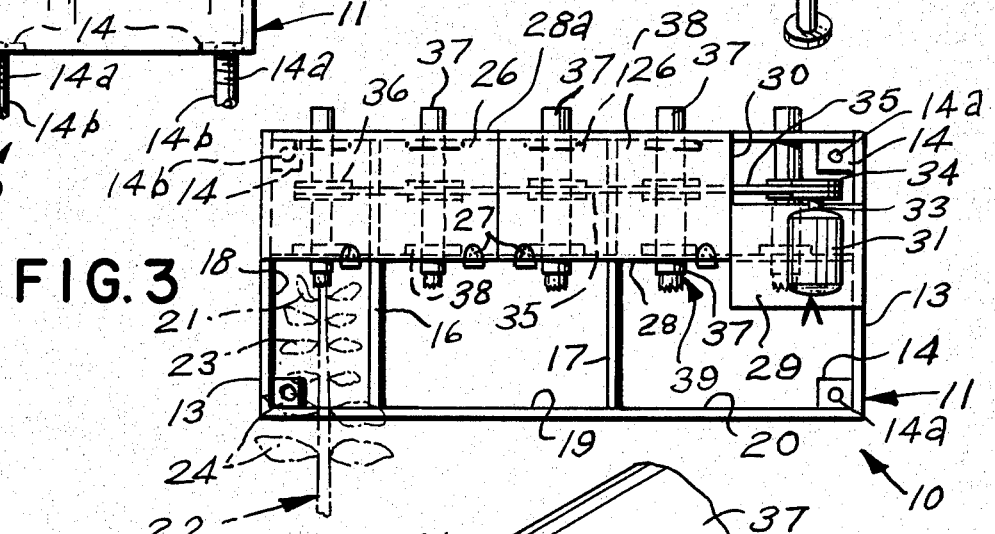
FIG. 3
37
36
26
28a
38
30
35
14a
14
34
33
31
14b
27
18
21
23
13
24
22
16
38
35
28
39
29
17
19
20
11
10
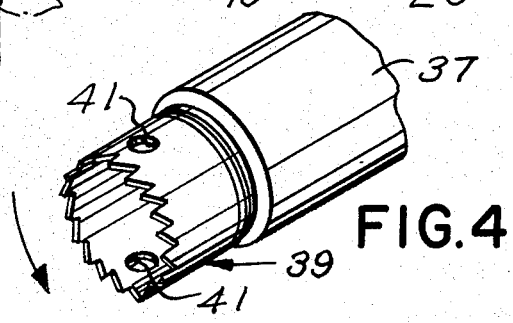
FIG. 4
41
37
39

TOBACCO STRIPPER

This invention relates to stripping devices, and more particularly, to a mechanical tobacco stripper.

It is, therefore, the principal object of this invention to provide a mechanical tobacco stripper, which will be used on the tobacco farm to strip effectively, the leaves from tobacco stalks, which will be dropped into different openings of the base of the machine, for separating the different grades of tobacco, such as the "tip grade," "the Leaf grade," and the "trash grade."

Another object of this invention is to provide a mechanical tobacco stripper, which will have a raised base, supported upon legs, so as to enable containers to be placed under each compartment opening, for collecting the three different grades of tobacco, and only one person will be needed to operate the stripper.

Another object of this invention is to provide a mechanical tobacco stripper, which will be of such construction, that it will enable the user to be seated while operating it, thus preventing unnecessary fatigue when operating it.

A further object of this invention is to provide a mechanical tobacco stripper, which will be elevatable in height, so as to adapt it to the height of different operators, in order that they will be comfortable.

Other objects of the present invention are to provide a mechanical tobacco stripper, which is simple in design, inexpensive to manufacture, rugged in construction, easy to use and efficient in operation.

These, and other objects, will be readily evident upon a study of the following specification and the accompanying drawing wherein:

FIG. 1 is a perspective view of the present invention, showing a tobacco stalk in phantom, for illustration purposes;

FIG. 2 is a fragmentary side elevational view of FIG. 1;

FIG. 3 is a top plan view of FIG. 1, showing the pulley and belt-driven cutters, in the upper housing of the stripping machine, and FIG. 4 is an enlarged fragmentary perspective view of one of the cutters and its mounting tube.

According to this invention, machine 10 is shown to include a rectangularly configurated base 11, having side walls 12, and end walls 13. Base 11 includes, in its bottom, a plurality of plates 14, welded or otherwise secured to side walls 12 and end walls 13, for threadingly receiving the upper threaded portions **14*a* of legs 14*b*, which support base 11 on a ground surface. The legs 14*b* enable the base to be elevated or lowered, as desired, so as to accommodate persons of various heights, without discomfort, when operating machine 10**.

A pair of spaced-apart divider walls 16 and 17 are fixedly secured, at their side edges, to and between side walls 12, in a suitable manner, so as to form compartments 18, 19, and 20. Compartment 18 is for receiving the "tip grade" leaves 21 of the tobacco stalk 22, and compartment 19 is for receiving the "leaf grade" 23 cut from the stalk 22. Compartment 20 is for receiving the "trash grade" of leaves 24, cut from the stalk 22, and containers (not shown) for each "grade," are placed under the respective compartments, for receiving the heretofore described "grades" of tobacco.

A rectangularly configurated housing 25 is fixedly secured, in a suitable manner, to the end walls 13 and one of the side walls 12, at the top portion of base 11, and protective covers 26 are hinged, by hinge 27 means, to the front wall 28 of housing 25. A flat plate 29 is fixedly secured, in a suitable manner, to one end of housing 25, over end opening 30, and an electric motor 31 is secured to plate 29, by suitable fasteners 32. The shaft 33, of motor 31, includes a common adjustable pulley 34, upon which a belt 35 is received, for driving pulleys 36, that are secured to tubes 37, that are journaled within suitable bearings 38, mounted to the front wall 28 and the rear wall **28*a* of housing 25. Removably threaded into each tube 37 is a cylindrical cutter 29, having a plurality of very sharp cutting teeth 40, for removing leaves 21, 23, and 24 from the tobacco stalks 22. Transverse openings 41 are included in cutters 39, so as to place or remove them from their respective tubes 37**, by suitable tool means.

It shall be noted, that bearings 38 are secured to housing 25, by means of suitable fasteners **38*a*, and base 11 may be modified, so as to have bottom walls therein, rather than the heretofore described open-bottomed compartments 18, 19, and 20**.

In use, motor 31, secured in common circuit means (not shown), is turned on, by suitable switch means in the circuit, which will simultaneously rotate the plurality of tubes 37 and their cutters 39, by means of the pulleys 34 and 36 and belt 35 means, so as to cut the different grades of tobacco from the stalks 22.

While various changes may be made in the detail construction, it is understood that such changes will be within the spirit and scope of the present invention, as is defined by the appended claims.

What I now claim is:

1. A mechanical tobacco stripper, comprising, in combination, a rectangular base formed by a pair of opposite side walls and a pair of opposite end walls, a pair of vertical partitions inside said base forming a plurality of compartments inside said base, a narrow housing secured upon said base, covering one end of each said compartment, an electric motor mounted upon the top of said housing, a pulley affixed on a shaft of said motor, an endless belt around said pulley and around a plurality of driving pulleys inside said housing, a plurality of horizontal tubes extending transversely through said housing and supported rotatably free in bearings of opposite side walls of said housing, one said driving pulley being affixed on each one of said tubes, one outwardly extending end of said tubes being above a top open end of said compartments, a circular cutter mounted within said tube end above said compartment top open ends, and said base being mounted upon downward legs.

2. The combination as set forth in claim 1, wherein at least one of said cutters is above each one of said compartments, whereby tobacco stripped by said cutter from a tobacco plant stalk slid in said tube, drops into said compartment.

* * * * *